US009322514B2

(12) United States Patent
Block et al.

(10) Patent No.: US 9,322,514 B2
(45) Date of Patent: Apr. 26, 2016

(54) LIGHTING MODULE

(75) Inventors: Steffen Block, Lauterach (AT); Rainer Huber, Bad Abbach (DE)

(73) Assignee: OSRAM Opto Semiconductors GmbH, Regensburg (DE)

( * ) Notice: Subject to any disclaimer, the term of this patent is extended or adjusted under 35 U.S.C. 154(b) by 1153 days.

(21) Appl. No.: 13/127,235

(22) PCT Filed: Oct. 20, 2009

(86) PCT No.: PCT/DE2009/001463

§ 371 (c)(1),
(2), (4) Date: Oct. 31, 2011

(87) PCT Pub. No.: WO2010/048924

PCT Pub. Date: May 6, 2010

(65) Prior Publication Data

US 2012/0092868 A1 Apr. 19, 2012

(30) Foreign Application Priority Data

Oct. 31, 2008 (DE) ..... 10 2008 054 233

(51) Int. Cl.

| | |
|---|---|
| ***F21S 4/00*** | (2006.01) |
| ***F21K 99/00*** | (2010.01) |
| ***F21V 29/00*** | (2015.01) |
| *F21Y 101/02* | (2006.01) |
| *F21Y 105/00* | (2006.01) |

(Continued)

(52) U.S. Cl.

CPC ..... *F21K 9/00* (2013.01); *F21V 29/004* (2013.01); *F21V 29/40* (2013.01); *F21V 29/507* (2015.01); *F21V 29/74* (2015.01); *F21V 29/89* (2015.01); *F21Y 2101/02* (2013.01); *F21Y 2105/00* (2013.01)

(58) Field of Classification Search

CPC ..... F21V 29/00; F21V 29/85; F21V 29/20; F21V 29/74; F21V 29/89; F21V 29/507; F21Y 2105/001; F21Y 2105/006

USPC ..... 362/249.01

See application file for complete search history.

(56) References Cited

U.S. PATENT DOCUMENTS 4,774,630 A * 9/1988 Reisman et al. ..... 361/718
5,268,812 A * 12/1993 Conte ..... 361/698

(Continued)

FOREIGN PATENT DOCUMENTS

| | | |
|---|---|---|
| CA | 2 682 631 | 10/2008 |
| DE | 299 15 399 | 1/2000 |

(Continued)

OTHER PUBLICATIONS

Schnitzer et al. Appl. Phys. Letters 63 (16), Oct. 18, 1993, pp. 2174-2176.

*Primary Examiner* — Anabel Ton
(74) *Attorney, Agent, or Firm* — Cozen O'Connor

(57) ABSTRACT

A luminous module comprising a plurality of radiation-emitting semiconductor components (2), a connection carrier (3), on which the radiation-emitting semiconductor components (2) are arranged, and a cooling body (6), which, on its front-side surface, is connected to the connection carrier (3) and has a basic body (4) and also a means (5), which is designed to locally alter the thermal resistance of the cooling body (6), wherein the average thermal resistance of the cooling body (6) decreases along a main extension direction of the luminous module (1).

13 Claims, 7 Drawing Sheets

(51) Int. Cl.

| | |
|---|---|
| *F21V 29/507* | (2015.01) |
| *F21V 29/74* | (2015.01) |
| *F21V 29/89* | (2015.01) |

(56) References Cited

U.S. PATENT DOCUMENTS

| | | | | |
|---|---|---|---|---|
| 5,857,767 | A * | 1/1999 | Hochstein | 362/294 |
| 5,981,085 | A * | 11/1999 | Ninomiya et al. | 428/614 |
| 6,896,039 | B2 * | 5/2005 | Dussinger et al. | 165/104.26 |
| 7,674,010 | B2 * | 3/2010 | Griffiths et al. | 362/249.02 |
| 7,758,223 | B2 * | 7/2010 | Osawa et al. | 362/547 |
| 7,973,332 | B2 * | 7/2011 | Fukui | 257/99 |
| 2004/0116792 | A1 * | 6/2004 | Nesbitt | 600/373 |
| 2006/0011598 | A1 * | 1/2006 | Yasuda | 219/205 |
| 2007/0167054 | A1 * | 7/2007 | Wu | B60Q 3/0279 439/238 |
| 2008/0043480 | A1 | 2/2008 | Kong | |
| 2011/0311831 | A1 * | 12/2011 | Suzuki et al. | 428/457 |
| 2012/0201031 | A1 * | 8/2012 | Marley | 362/294 |

FOREIGN PATENT DOCUMENTS

| | | |
|---|---|---|
| DE | 202 02 684 | 9/2002 |
| DE | 103 39 412 | 4/2005 |
| DE | 20 2006 002 797 | 6/2006 |
| DE | 20 2007 009 272 | 12/2007 |
| DE | 20 2007 015 497 | 4/2008 |
| EP | 1 965 128 | 9/2008 |
| JP | 08-282496 | 10/1996 |
| JP | 2007-059207 | 3/2007 |
| JP | 2007-142256 | 6/2007 |
| WO | WO 2006/043379 | 4/2006 |
| WO | WO 2008/119392 | 10/2008 |

* cited by examiner

LIGHTING MODULE

RELATED APPLICATIONS

This application is a U.S. National Phase Application under 35 USC 371 of International Application No. PCT/DE2009/001463, filed on 20 Oct. 2009.

This patent application claims the priority of the German patent application DE10 2008 054 233.4 filed 31 Oct. 2008, the disclosure content of which is hereby incorporated by reference.

FILED OF THE INVENTION

A luminous module is specified which is suitable for large-area backlighting or illumination applications.

BACKGROUND OF THE INVENTION

In large-area backlighting applications such as in light advertising, advertising panels are used, for example, which are equipped with photographic images and backlighting devices for illuminating the photographic images. If the backlighting is effected by LEDs, then junction temperatures of different magnitudes can arise for the different LEDs. The advertising panels are typically situated in an upright position. As a result, the LEDs in the lower region of the advertising panel can emit their heat upward. This has the consequence that the LEDs in the middle and upper regions of the advertising panel are exposed to a higher temperature than the LEDs in the lower region, which leads to higher junction temperatures of these LEDs. However, different junction temperatures of the LEDs give rise to different brightnesses in the application and cause a color locus shift. In long-term application this can additionally lead to different aging behavior of the LEDs, which is in turn manifested in a color locus shift and a change in brightness.

SUMMARY OF THE INVENTION

One object of the invention is to provide a luminous module having stable color and brightness properties.

In accordance with one preferred embodiment, the luminous module comprises a plurality of radiation-emitting semiconductor components, a connection carrier, on which the radiation-emitting semiconductor components are arranged, and a cooling body, which, on its front-side surface, is connected to the connection carrier and comprises a basic body and also a means, which is designed to locally alter the thermal resistance of the cooling body, wherein the average thermal resistance of the cooling body decreases along a main extension direction of the luminous module.

The average thermal resistance is a measure of the temperature difference that arises on average when a heat flow (heat per unit time or thermal power) passes through the cooling body along a main extension direction of the luminous module. The luminous area of the luminous module can be subdivided into a lower, middle and upper region. Each region can be assigned an average thermal resistance. Preferably, the average thermal resistance is higher in the lower region than in the middle or upper region.

In other words, the luminous module can be described as follows: the luminous module comprises a cooling body comprising a basic body and also a means. The means has, for example, a thermal resistance that differs from the thermal resistance of the basic body. In this way, the cooling body has a different thermal resistance in the region of the means than in the region of the basic body. The means can therefore ensure that the cooling body does not have a uniform thermal resistance—for example the thermal resistance of the basic body—, rather that the thermal resistance is varied locally. In particular, with the means it is possible for the thermal resistance of the cooling body to be set in such a way that the cooling body has the thermal resistance of the basic body in some locations and at other locations the thermal resistance of the cooling body deviates from the thermal resistance of the basic body. By way of example, the thermal resistance of the cooling body in the region of the means is greater or less than the thermal resistance of the basic body. With the aid of the means it is then possible, for example, to realize a cooling body in which the average thermal resistance varies, for example decreases, along a main extension direction of the luminous module.

The luminous module preferably has a planar shape, that is to say that the depth of the luminous module is less than the length and width of the luminous area of the luminous module. In this case, the luminous module has two main extension directions: the first main extension direction runs parallel to the longitudinal side of the luminous module; the second main extension direction runs parallel to the broad side of the luminous module. In the present case, the relevant main extension direction is, in particular, the one which, with upright mounting of the luminous module, points in the opposite direction to the force of gravity. The main extension direction then extends from the lower to the upper region.

As already mentioned in the introduction, when the luminous module is in an upright position, the radiation-emitting components are conventionally exposed to a higher temperature in the middle and upper regions of the luminous module than in the lower region. Advantageously, in the case of a luminous module according to the invention, the temperature difference between the lower region and the other regions can be reduced. This is because, as a result of the decrease in the average thermal resistance along the main extension direction extending, in particular, in the opposite direction to the force of gravity, poorer heat conduction takes place in the lower region than in the middle and upper regions. Consequently, the temperature in the lower region increases, and the temperature difference between the lower region and the other regions decreases. This in turn leads to improved color locus and brightness properties of the luminous module and to the stability thereof.

The radiation-emitting semiconductor components can be unpackaged semiconductor chips or compact devices comprising semiconductor chips arranged in packages. Preferably, the semiconductor chips are produced using thin-film technology.

A thin-film light-emitting diode chip is distinguished, in particular, by at least one of the following features:

- a reflective layer is applied or formed at a first main area, facing toward a carrier element, of a radiation-generating epitaxial layer sequence, said reflective layer reflecting at least part of the electromagnetic radiation generated in the epitaxial layer sequence back into the latter;
- the epitaxial layer sequence has a thickness in the range of 20 μm or less, in particular in the region of 10 μm; and
- the epitaxial layer sequence contains at least one semiconductor layer having at least one area having an intermixing structure which ideally leads to an approximately ergodic distribution of the light in the epitaxial layer sequence, that is to say that it has an as far as possible ergodically stochastic scattering behavior.

A basic principle of a thin-film light-emitting diode chip is described, for example, in I. Schnitzer et al., Appl. Phys. Lett.

63 (16), 18 Oct., 1993, 2174-2176, the disclosure content of which in this respect is hereby incorporated by reference.

A thin-film light-emitting diode chip is, to a good approximation, a Lambertian surface emitter.

White light is often preferred for backlighting applications. The generation of white light can be realized, on the one hand, by the use of semiconductor components which already emit white light. On the other hand, it is possible to use semiconductor components which emit differently colored light which in total produces white light. By way of example, it is possible to use red, green and blue light-emitting semiconductor components, the light of which is mixed. A balanced temperature within the luminous module is particularly important in this case. This is because at higher temperatures the brightness of red light-emitting semiconductor components decreases to a greater extent than in the case of green and blue light-emitting semiconductor components. Consequently, different white points are to be expected at different temperatures. This problem can be successfully prevented in the case of the luminous module according to the invention.

In one advantageous configuration of the luminous module, the connection carrier, on which the radiation-emitting semiconductor components are arranged, is a printed circuit board. Preferred printed circuit boards are metal-core printed circuit boards (so-called MCPCBs) or carriers which contain a laminate composed of resin and glass fiber fabric (so-called FR4) and are provided with thermal vias, preferably metal plated-through holes, for improved heat conduction. On a surface facing away from the semiconductor components, the connection carrier can comprise a thermal interface material (so-called TIM) which improves the thermal contact between connection carrier and cooling body.

Preferably, the radiation-emitting semiconductor components are distributed uniformly on the connection carrier. This means that the number of radiation-emitting semiconductor components per unit area is constant.

Particularly preferably, the semiconductor components are electrically connected to the connection carrier.

The basic body of the cooling body can have a uniform thermal resistance. In accordance with one preferred variant of the luminous module, the basic body of the cooling body contains a metal or consists of a metal. By way of example, the basic body can be formed from an aluminum plate.

In accordance with one advantageous embodiment, the means is distributed non-uniformly in the cooling body. This means that there is a change in the number of elements that the means comprises per unit area.

Depending on the means, the number of elements per unit area can decrease or increase along the main extension direction. As a result of the increase or decrease in the number of elements per unit area, it is advantageously possible to bring about a decrease in the thermal resistance of the cooling body along the main extension direction.

Preferably, the unit of area corresponds to the size of the regions. The fact of whether the number of elements increases or decreases along the main extension direction results, in particular, from a comparison of the number of elements in the lower region with the number of elements in the middle or upper region.

In one preferred configuration, the means comprises at least one thermally insulating element having a greater thermal resistance than the basic body of the cooling body. Advantageously, the thermally insulating element or the thermally insulating elements is or are arranged at or in the basic body in such a way as to make it more difficult for a heat flow to pass through in the region of the element or elements by comparison with other regions. As a result, the thermal resistance of the cooling body is increased locally in the region of the element or elements.

In accordance with one advantageous development, the number of thermally insulating elements per unit area decreases along the main extension direction. As a result, the average thermal resistance of the cooling body also decreases along the main extension direction.

In one preferred configuration, the luminous module has, on a rear-side surface or on at least one side area of the cooling body, a plurality of thermally insulating elements, the number of which per unit area decreases along the main extension direction. By way of example, a plurality of thermally insulating elements can be arranged on a single side area, while no thermally insulating elements are present on the further side areas. Preferably, the thermally insulating elements are arranged in the lower region of the luminous module in the case of upright mounting of the luminous module.

Furthermore, in each case at least one thermally insulating element can be arranged on more than one side area. The thermally insulating elements are advantageously arranged on the side areas or the rear-side surface in such a way that they are situated in the lower region of the luminous module in the case of upright mounting of the luminous module.

The at least one thermally insulating element is preferably formed from a plastics material.

However, the at least one thermally insulating element can also be a cutout in the basic body of the cooling body, said cutout being filled with a material having a higher thermal resistance than the basic body. In particular, the cutout extends from the front-side surface of the cooling body as far as the rear-side surface of the cooling body. Preferably, the cutout is filled with air. A simple method for producing a cooling body of this type consists in stamping at least one cutout into a metal plate, preferably an aluminum plate. Advantageously, the cooling body contains a plurality of cutouts arranged in regions that are not covered by the radiation-emitting semiconductor components. Consequently, the cutouts are situated between the semiconductor components. The semiconductor components are arranged above the basic body. The operating heat can thereby be dissipated from the semiconductor components well by means of the basic body.

In addition or as an alternative to the at least one thermally insulating element, the means can contain at least one thermally conductive element having a thermal resistance that is less than or equal to the thermal resistance of the basic body. Advantageously, the thermally conductive element or the thermally conductive elements is or are arranged at or in the basic body in such a way as to make it easier for a heat flow to pass through in the region of the element or elements by comparison with other regions of the cooling body. As a result, the thermal resistance of the cooling body can be reduced locally in the region of the element or elements.

In accordance with one preferred embodiment, the number of thermally conductive elements per unit area increases along the main extension direction. As a result, the average thermal resistance of the cooling body decreases along the main extension direction.

The at least one thermally conductive element can be arranged on the front-side surface, the rear-side surface or at least one side area of the cooling body.

By way of example, the cooling body can project laterally beyond the connection carrier, such that a thermally conductive element can be arranged in the projecting region of the cooling body on the front-side surface thereof. A configuration of this type is suitable, in particular, for the connection of the thermally conductive element to a thermally conductive frame that frames the radiation-emitting semiconductor components. A frame of this type can for example be provided in the case of an advertising panel and enclose the photographic image. Advantageously, in the case of this configuration, the heat can be dissipated from the luminous module via the frame. In particular, the thermally conductive element is arranged in such a way that it is situated in the middle to upper region of the luminous module in the case of upright mounting of the luminous module.

Furthermore, at least one thermally conductive element can be arranged on the rear-side surface of the cooling body. Furthermore, at least one thermally conductive element can be arranged on only one side area or more than one side area of the cooling body. Here, too, the at least one thermally conductive element is arranged, in particular, in such a way that it is situated in the middle to upper region of the luminous module in the case of upright mounting of the luminous module.

In one advantageous embodiment of the luminous module, the at least one thermally conductive element contains a metal or consists of a metal. Advantageously, the thermally conductive element has a structured surface. By way of example, the surface can be structured in the form of cooling ribs, such that a cooling fluid such as air can flow through the interspaces of the cooling ribs.

In accordance with one preferred development, the means is at least partly a fixing means. By way of example, the luminous module can have at least one thermally insulating element which serves as a fixing element. Additionally or alternatively, the luminous module can have at least one thermally conductive element which serves as a fixing element.

The luminous module can be used for backlighting or illumination applications as light source in a luminous unit.

In particular, the luminous unit comprises a housing, in which the luminous module is arranged. Advantageously, in this case the means of the cooling body is at least partly a fixing means, such that the luminous module can be fixed to the housing in a simple manner.

In accordance with one preferred embodiment of the luminous unit, at least one part of the housing is embodied in thermally conductive fashion, that is to say that a part of the housing contains a material having a thermal resistance that is less than or equal to the thermal resistance of the basic body of the cooling body. By way of example, the thermally conductive part of the housing is a metal frame that borders the luminous module.

Preferably, the cooling body is thermally connected to the thermally conductive part of the housing. This advantageously facilitates the cooling of the luminous module.

In one advantageous configuration of the luminous unit, the thermal connection between the cooling body and the thermally conductive part of the housing is produced at least partly by the means of the cooling body.

For two-sided applications, the luminous unit can comprise two luminous modules, the cooling bodies of which face one another.

In accordance with one preferred embodiment, the connection carrier is not embodied in one piece, but rather is composed of a plurality of partial carriers. By way of example, in the case where the components are arranged in a plurality of rows, the components in a row can in each case be arranged on a common partial carrier.

DETAILED DESCRIPTION OF THE DRAWINGS

In the exemplary embodiments and figures, identical or identically acting constituent parts are provided with the same reference symbols.

Figure 1:
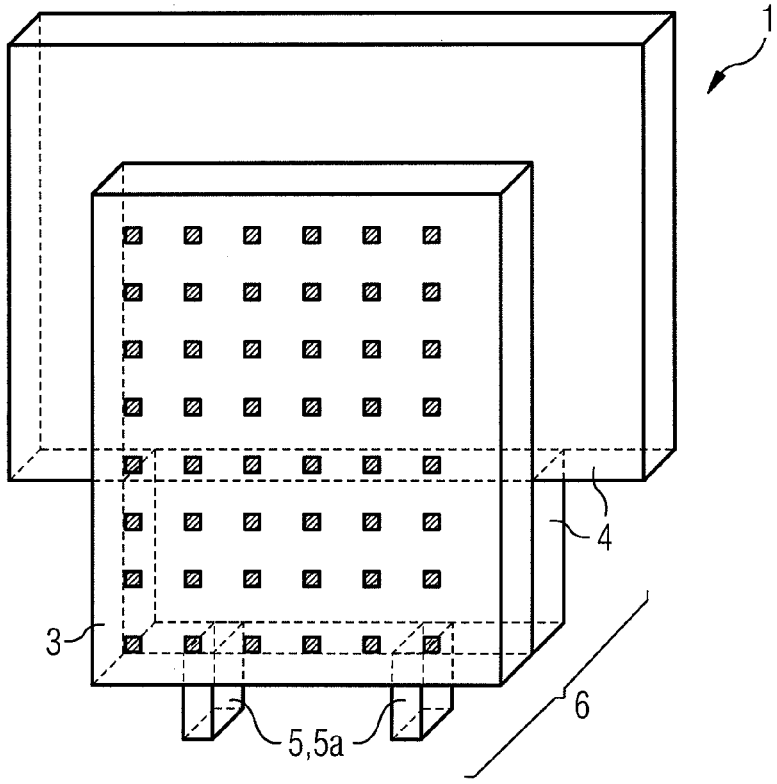
FIG. 1 shows a perspective illustration of a first exemplary embodiment of a luminous module according to the invention.

The luminous module 1 illustrated in FIG. 1 comprises a plurality of radiation-emitting semiconductor components 2 arranged on a connection carrier 3. The luminous module 1 has a planar shape, that is to say that the depth of the luminous module 1 is less than the length and width of the luminous area of the luminous module 1. The two main extension directions of the luminous module 1 run parallel to the x direction and y direction (cf. FIG. 2). In the case of upright mounting of the luminous module 1, the main extension direction that acts in the opposite direction to the force of gravity g (cf. FIG. 2) is crucial for determining the average thermal resistance.

The connection carrier 3 is a printed circuit board, for example a metal-core printed circuit board, or an FR4-based carrier comprising thermal vias. The contour of the connection carrier 3 is rectangular.

The radiation-emitting semiconductor components 2 are distributed uniformly on the connection carrier 3 and arranged at lattice points of a two-dimensional lattice.

The connection carrier 3 is arranged on a cooling body 6. In particular, a rear-side surface of the connection carrier 3 and a front-side surface of the cooling body 6 are in contact with one another. A thermal interface material for improving the thermal contact between connection carrier 3 and cooling body 6 can be applied on the rear-side surface of the connection carrier 3.

The cooling body 6 comprises a basic body 4 and a means 5, which is designed to locally alter the thermal resistance of the cooling body 6. The basic body 4 is, in particular, a metal plate which, for example, contains aluminum or consists of aluminum. The means 5 comprises two thermally insulating elements 5*a*, which preferably contain a plastics material. The two thermally insulating elements 5*a* are arranged at a side area of the cooling body 6 in the lower region of the luminous module 1. They are fixed to the basic body 4. As a result of the arrangement of the means 5 in the lower region, the means 5 is distributed non-uniformly in the cooling body 6. The number of thermally insulating elements 5*a* decreases along the main extension direction.

While the basic body 4 is adapted to the size of the connection carrier 3 in the lower region of the luminous module 1, in the middle and upper regions of the luminous module 1 said basic body projects beyond the latter. Consequently, an edge of the basic body 4 surrounds the connection carrier 3 in the upper and middle regions of the luminous module 1. Preferably, the thermally insulating elements 5*a* do not project beyond the connection carrier 3 further than the edge of the basic body 4. The basic body 4 has a T-like form.

This luminous module 1 is preferably used in a luminous unit 7 (cf. FIG. 2), for example an advertising panel, comprising a housing having a housing frame 8 (cf. FIG. 2) that frames the connection carrier 3 with the radiation-emitting semiconductor components 2. That edge of the basic body 4 which surrounds the connection carrier 3 and also the thermally insulating elements 5*a* are then hidden behind the housing frame 8.

By means of the projecting edge of the basic body 4, the luminous module 1 can be fixed to the housing frame 8. As a result, the cooling body 6 is simultaneously in thermal contact with the housing frame 8. The housing frame 8 advantageously contains a material having a thermal resistance that is less than or equal to the thermal resistance of the basic body 4. This enables good cooling of the luminous module 1 in the upper and middle regions.

In the lower region, the luminous module 1 can be fixed to the housing frame 8 by means of the insulating elements 5*a*. The insulating elements 5*a* reduce the heat flow between the basic body 4 and the housing frame 8. This is also the case if the insulating elements 5*a* are omitted. In the lower region a thermally insulating interspace is then situated between the luminous module 1 and the housing frame 8. The luminous module 1 is then fixed to the housing frame 8 and thermally connected thereto only by the projecting edge of the basic body 4.

This luminous module 1 is suitable, in particular, for a luminous unit in which the luminous area is smaller than the external dimensions of the luminous unit.

Figure 2:
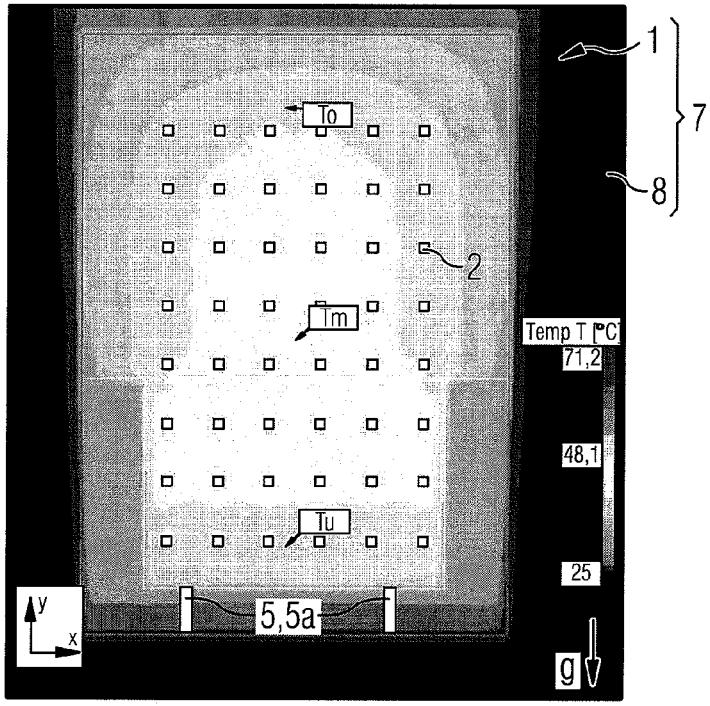
FIG. 2 shows a temperature diagram for the luminous module illustrated in FIG. 1.

The diagram in FIG. 2 shows the temperature distribution for the luminous module 1 illustrated in FIG. 1. As emerges from the diagram, the temperature Tu prevailing in the lower region of the luminous module 1 and the temperature To prevailing in the upper region of the luminous module 1 are approximately identical. The exact values are Tu=39.3° C. and T0=39.8° C. The temperature Tm prevailing in the middle region of the luminous module 1 is only slightly higher. Its value is Tm=41.3° C. As a result, the radiation-emitting semiconductor components 2 are exposed to temperatures that differ from one another by not more than 2° C.

Figure 3:
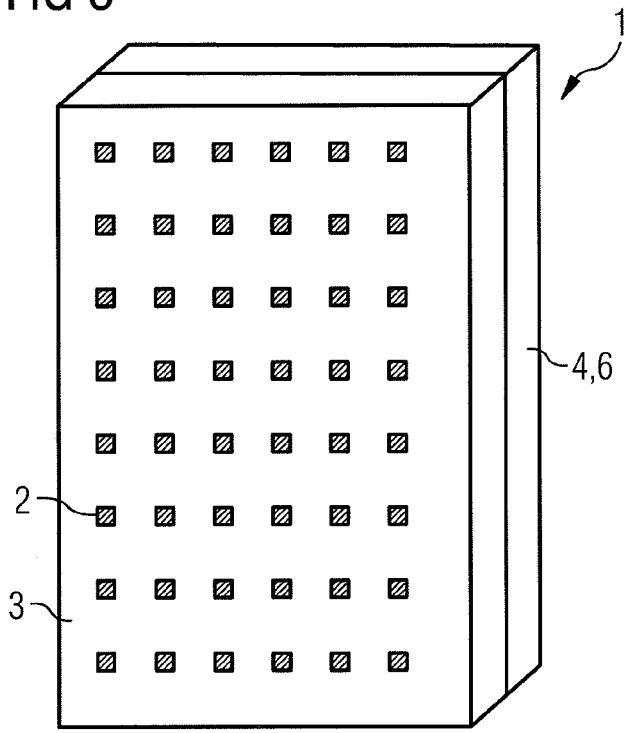
FIG. 3 shows a perspective illustration of a luminous module in accordance with the prior art.
Figure 4:
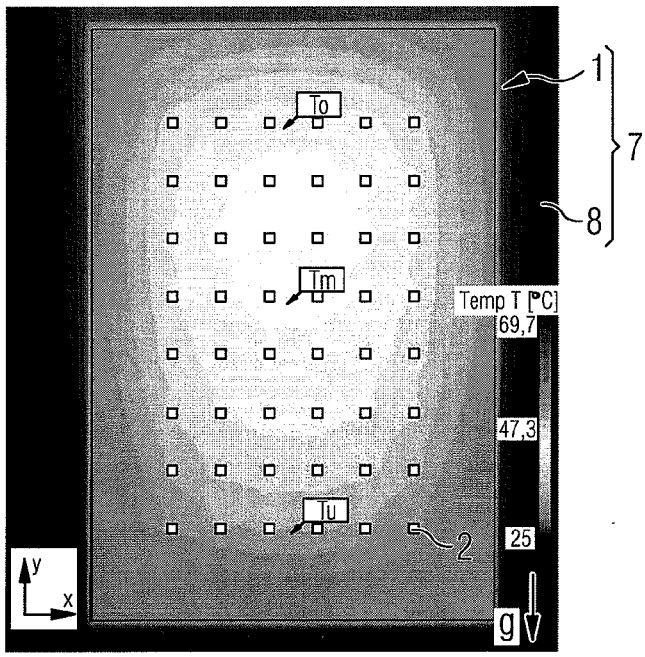
FIG. 4 shows a temperature diagram for the luminous module illustrated in FIG. 3, FIGS. 5 to 8 show line diagrams for illustrating the temperature behavior of different light-emitting diodes.

In contrast to this, in a luminous module 1 without means for locally changing the thermal resistance, such as is illustrated in FIG. 3, greater temperature fluctuations occur. The luminous module 1 comprises a cooling body 6 consisting solely of the basic body 4. Consequently, the cooling body 6 has a uniform thermal resistance. The cooling body 6 covers the entire area of the connection carrier 3. As a result, the radiation-emitting components 2 in the lower region of the luminous module 1 can emit their heat upward in an unimpeded manner. This has the consequence that the luminous module 1 is heated to a greater extent in the middle and upper regions than in the lower region. While the temperature in the lower region is Tu=34.8° C., it is Tm=39.8° C. in the middle region and To=38.6° C. in the upper region. Therefore, the radiation-emitting semiconductor components 2 in the case of the luminous module 1 illustrated in FIG. 3 are exposed to temperatures that differ from one another by more than 2° C., namely by up to 5° C. The temperature To=38.6° C. in the upper region is less than that in the middle region with Tm=39.8° C., because the cooling body 6 is connected to a housing frame 8 over the whole area (cf. FIG. 4).

What can therefore be brought about by a decrease in the average thermal resistance of the cooling body 6 along the main extension direction, as in the case of the luminous module 1 illustrated in FIG. 1, is that the temperature fluctuations in the luminous module 1 are reduced. This is because a higher average thermal resistance in the lower region leads to an increase in the temperature in the lower region. As a result, the temperature difference between the middle or upper region and the lower region can be reduced.

Figure 5:
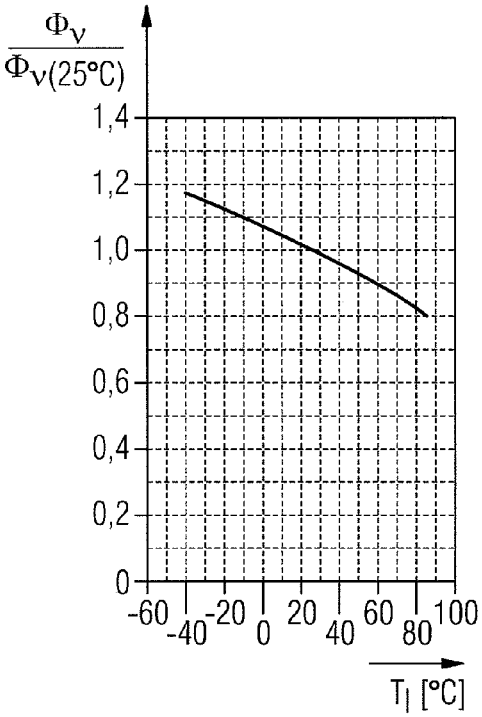
Figure 6:
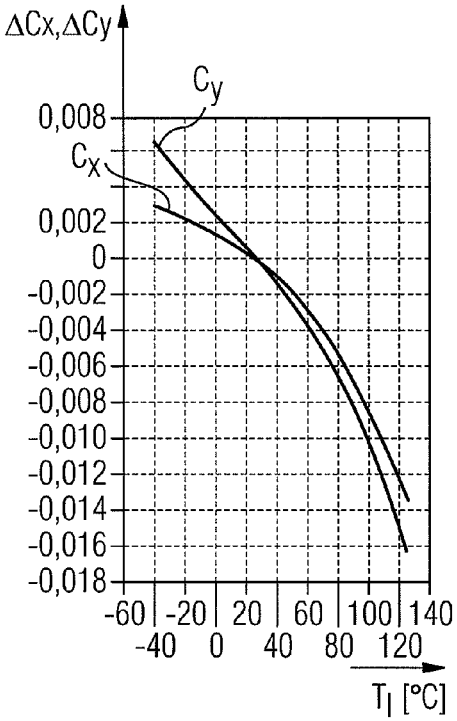

The graphs in FIGS. 5 and 6 show the temperature behavior of a light-emitting diode which is operated with a current of 350 mA and emits white light. A corresponding temperature behavior is exhibited by blue and green light-emitting diodes.

As emerges from the graph in FIG. 5, the relative luminous flux ΦV/ΦV (25° C.), which assumes the value 1.0 at 25° C., decreases as the temperature TI rises.

Furthermore, it is evident from the graph in FIG. 6 that a temperature increase leads to a color locus shift ΔCx, ΔCy. The color locus Cx, Cy measured at TI=25° C. is in this case used as a reference variable, such that the color locus shift ΔCx, ΔCy at this temperature is equal to zero.

Figure 7:
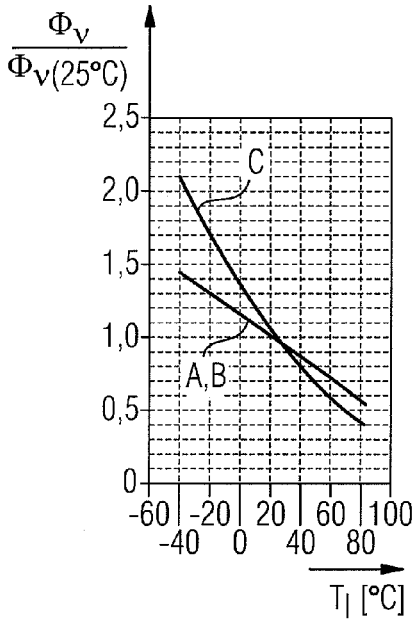
Figure 8:
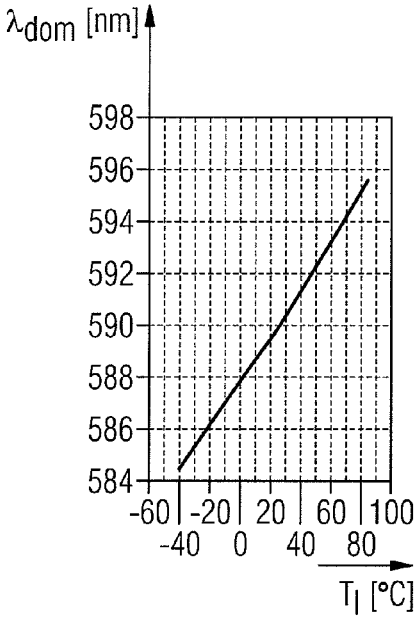

The graphs in FIGS. 7 and 8 show the temperature behavior of light-emitting diodes that emit single-colored light. The light-emitting diodes are operated with a current of 400 mA.

As emerges from the graph in FIG. 7, the relative luminous flux ΦV/ΦV (25° C.), which assumes the value 1.0 at 25° C., as the temperature TI rises, decreases to a greater extent in the case of a light-emitting diode that emits yellow light (curve C) than in the case of light-emitting diodes that emit red or orange light (curve A, B).

In the graph in FIG. 8, the profile of the dominant wavelength λdom with increasing temperature TI is illustrated for the light-emitting diode that emits yellow light. It can be seen that the dominant wavelength λdom is shifted to higher wavelengths as the temperature TI increases.

The graphs in FIGS. 5 to 8 illustrate the underlying problem here. If the different radiation-emitting semiconductor components of a luminous module are exposed to greatly different temperatures, then their radiation properties, for example the brightness, the color locus or the dominant wavelength, can differ from one another greatly. In order to ensure a sufficient operational stability, however, luminous modules having stable color and brightness properties are desired. This can be achieved in the case of a luminous module according to the present invention by means of a reduction of the temperature fluctuations within the luminous module.

Figure 9:
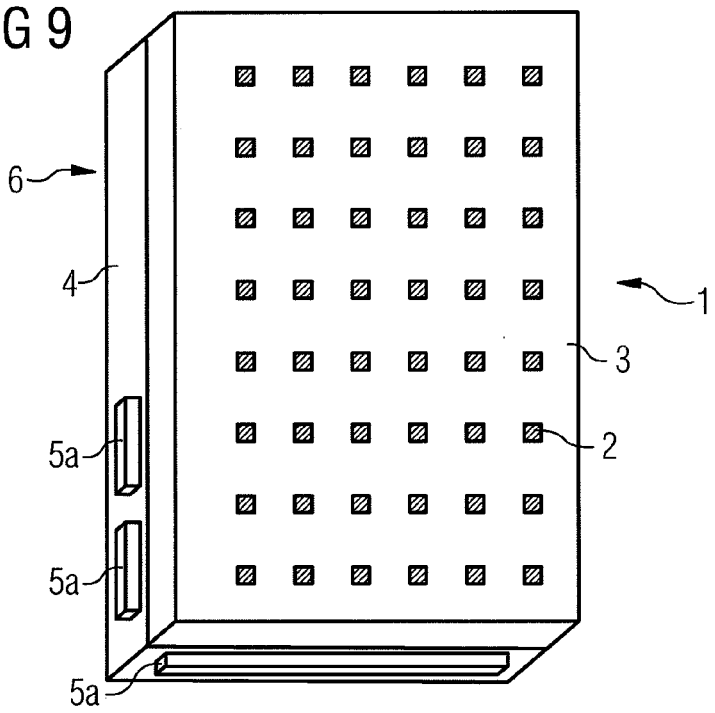
FIG. 9 shows a perspective illustration of a second exemplary embodiment of a luminous module according to the invention.

In the case of the luminous module 1 illustrated in FIG. 9, the connection carrier 3 is arranged on a basic body 4, which has a size corresponding to the connection carrier 3. In particular, the basic body 4 is a solid body having a constant density. The basic body 4 contains or consists of a metal and is preferably formed from a metal plate.

Thermally insulating elements 5*a* are arranged at side areas of the basic body 4, said elements containing a plastics material, in particular. In the case of upright mounting of the luminous module 1, the thermally insulating elements 5*a* are situated in the lower region of the luminous module 1.

In the case of this embodiment, the number of thermally insulating elements 5*a* per unit area decreases along the main extension direction. The average thermal resistance is higher in the lower region than in the middle and upper regions, on account of the thermally insulating elements 5*a*.

If the luminous module 1, in a luminous unit, is connected to a circumferential housing frame (not illustrated), then the housing frame is directly connected to the basic body 4 in the middle and upper regions, while the thermally insulating elements 5*a* are situated in the lower region between the basic body 4 and the housing frame.

This luminous module 1 is suitable, in particular, for a luminous unit in which the housing frame directly surrounds the luminous module 1, such that the luminous area substantially corresponds to the external dimensions of the luminous unit.

Figure 10:
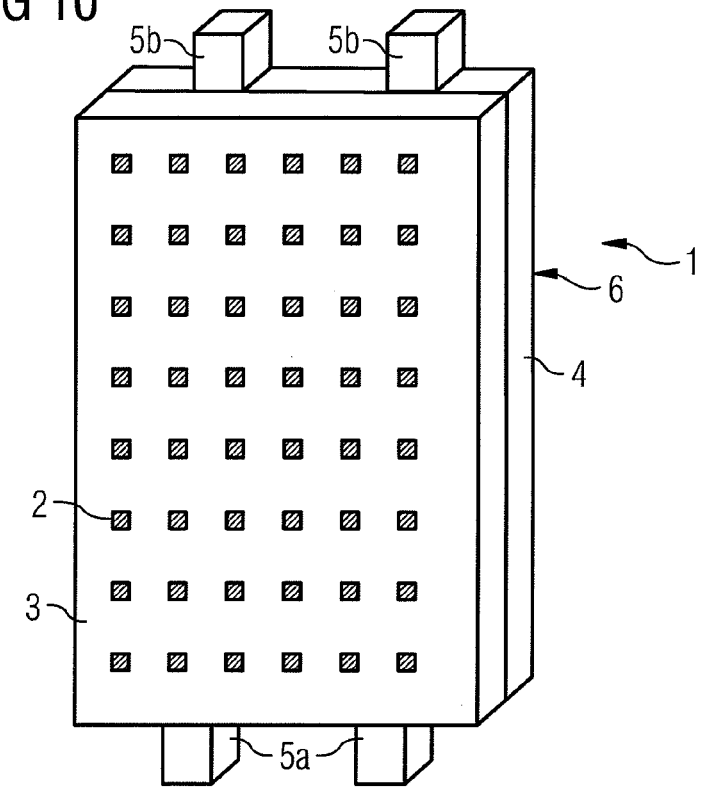
FIG. 10 shows a perspective illustration of a third exemplary embodiment of a luminous module according to the invention.

In the case of the luminous module 1 illustrated in FIG. 10, the connection carrier 3 is arranged on a basic body 4 having a size corresponding to the connection carrier 3. In particular, the basic body 4 is a solid body having a constant density. The basic body 4 contains or consists of a metal and is preferably formed from a metal plate.

In the case of this exemplary embodiment, the means of the cooling body 6 for locally changing the thermal resistance is provided in the lower and upper regions of the luminous module 1. The means comprises thermally insulating elements 5*a* and thermally conductive elements 5*b*. Preferably, the thermally insulating elements 5*a* contain a plastics material, while the thermally conductive elements 5*b* contain a metal. The means is distributed non-uniformly in the cooling body 6. The number of thermally insulating elements 5*a* per unit area decreases along the main extension direction, while the number of thermally conductive elements 5*b* per unit area increases along the main extension direction. As a result, it is possible to reduce the average thermal resistance in the main extension direction.

This luminous module 1 is preferably used for a luminous unit comprising a covering housing frame, which covers the thermally insulating elements 5*a* and the thermally conductive elements 5*b*. Particularly preferably, the thermally insulating elements 5*a* and the thermally conductive elements 5*b* serve as fixing means for fixing the luminous module 1 to the housing frame.

Figure 11A:
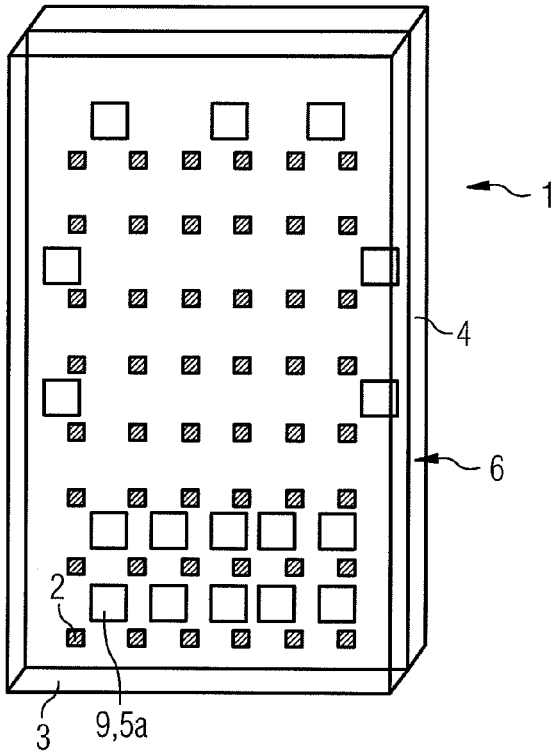
FIGS. 11A to 11C show a perspective illustration of a fourth exemplary embodiment of a luminous module according to the invention.

FIG. 11A shows a further exemplary embodiment of a luminous module 1 according to the invention. The basic body 4 has a size corresponding to the connection carrier 3. It is not a solid body having a constant density. Rather, the basic body 4 has cutouts 9 extending from a front-side surface as far as a rear-side surface of the cooling body 6.

Each cutout 9 constitutes a thermally insulating element 5*a*. The cutouts 9 are filled with a material having a higher thermal resistance than the basic body 4. Preferably, the cutouts 9 are filled with air. In order to produce the cooling body 6, the cutouts 9 can be stamped into a metal plate, preferably an aluminum plate.

Figure 11B:
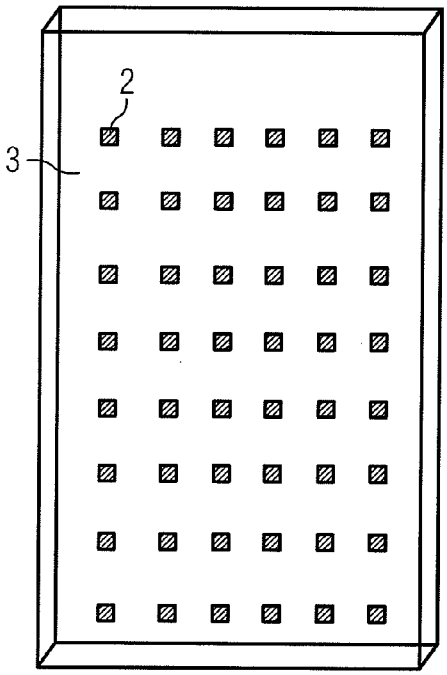

FIG. 11B shows, in a separate illustration, the connection carrier 3 of the luminous module 1 with the radiation-emitting semiconductor components 2 arranged thereon. The radiation-emitting semiconductor components 2 are distributed uniformly on the connection carrier 3.

Figure 11C:
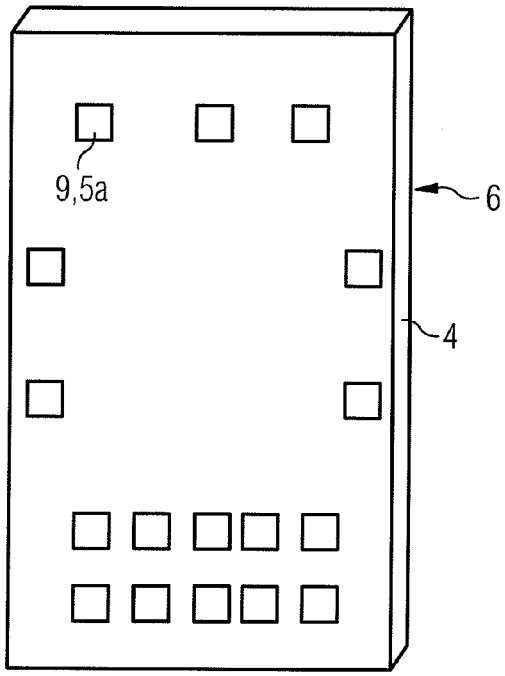

FIG. 11C shows, in a separate illustration, the cooling body 6 of the luminous module 1. The cutouts 9 are arranged more densely in the lower region of the cooling body 6 than in the middle and upper regions. The number of thermally insulating elements 5*a* per unit area decreases along the main extension direction. In the region of the thermally insulating elements 5*a*, the thermal resistance is increased locally. However, since the number of thermally insulating elements 5*a* per unit area decreases along the main extension direction, the average thermal resistance also decreases.

As emerges from FIG. 11A, the cutouts 9 are arranged in regions that are not covered by the radiation-emitting semiconductor components 2. Consequently, the cutouts 9 are situated between the semiconductor components 2. The semiconductor components 2 are arranged above the basic body 4. The operating heat can be dissipated from the semiconductor components well by means of the basic body 4.

Figure 12:
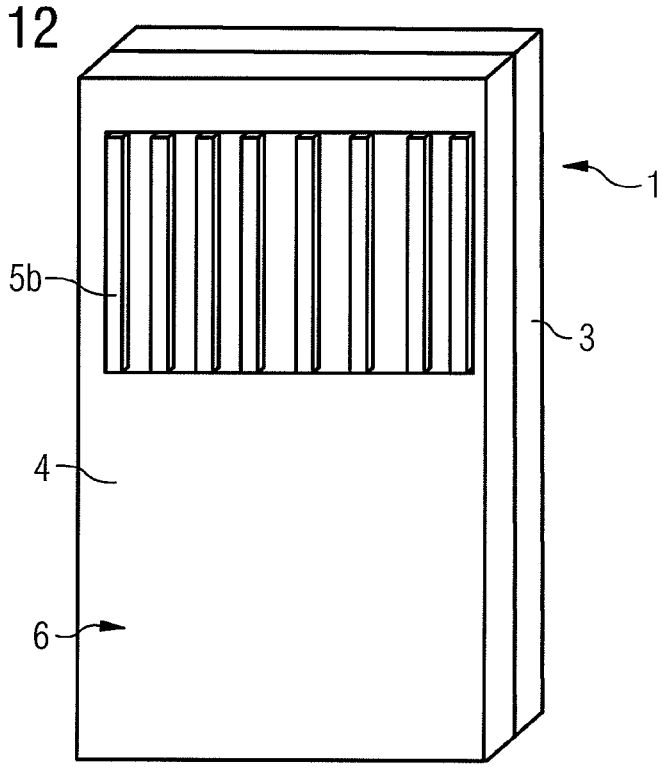
FIG. 12 shows a perspective illustration of a fifth exemplary embodiment of a luminous module according to the invention.

The luminous module 1 illustrated in FIG. 12 comprises, on the rear-side surface of the cooling body 6, a thermally conductive element 5*b* for locally reducing the thermal resistance. The number of thermally conductive elements per unit area therefore increases along the main extension direction. As a result, it is possible to achieve a decrease in the average thermal resistance along the main extension direction.

The thermally conductive element 5*b* has a structured surface. By way of example, the surface of the thermally conductive element 5*b* can be structured in the form of cooling ribs, such that a cooling fluid such as air can flow through the interspaces of the cooling ribs.

When this luminous module 1 is used in a luminous unit, the thermally conductive element 5*b* is advantageously brought into thermal contact with the thermally conductive part of the housing.

Figure 13:
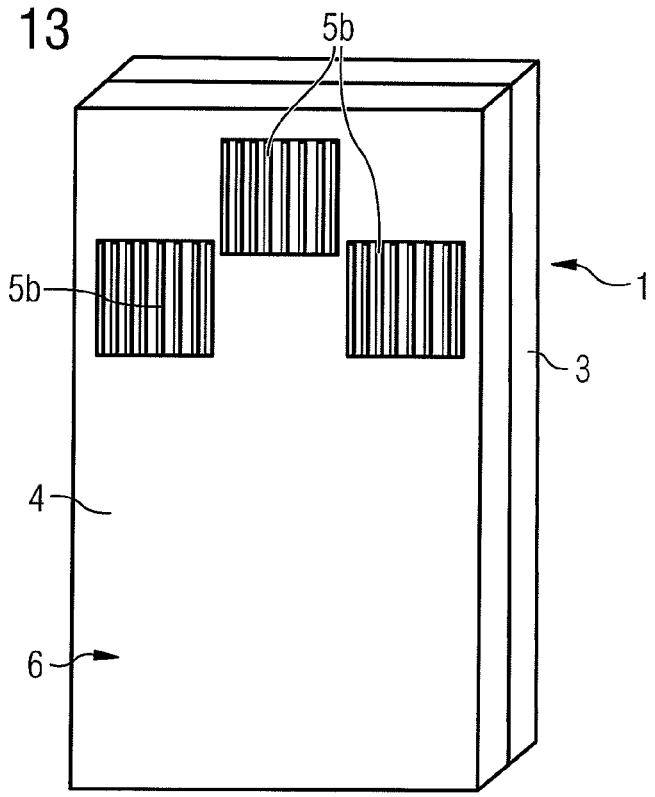
FIG. 13 shows a perspective illustration of a sixth exemplary embodiment of a luminous module according to the invention.

In the case of the luminous module 1 illustrated in FIG. 13, in contrast to the luminous module 1 illustrated in FIG. 12, the cooling body 6 does not comprise just one thermally conductive element 5*b*, but rather a plurality of thermally conductive elements 5*b* on the rear-side surface. The thermally conductive elements 5*b* are arranged in the upper region of the luminous module 1. Here, too, the number of thermally conductive elements per unit area increases along the main extension direction and the average thermal resistance thus decreases.

Figure 14:
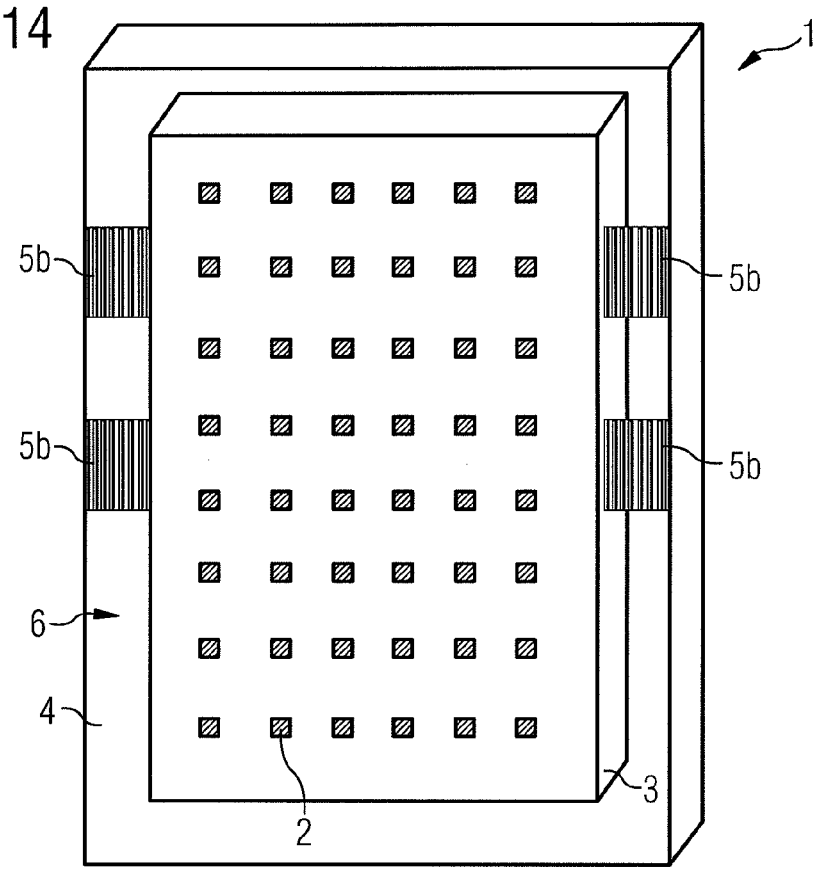
FIG. 14 shows a perspective illustration of a seventh exemplary embodiment of a luminous module according to the invention.

The luminous module 1 illustrated in FIG. 14 also comprises a plurality of thermally conductive elements 5*b*. The latter are arranged on a front-side surface of the cooling body 6. The basic body 4 of the cooling body 6 has a larger basic area than the connection carrier 3. Therefore, an edge of the basic body 4 surrounds the connection carrier 3 arranged centrally on the basic body 4. The thermally conductive elements 5*b* are situated in this edge region. Furthermore, the thermally conductive elements 5*b* are arranged in the middle and upper regions of the luminous module 1. The average thermal resistance of the cooling body 6 is reduced in the region of the thermally conductive elements 5*b*. Since the number of thermally conductive elements 5*b* per unit area increases along the main extension direction, the average thermal resistance consequently decreases along the main extension direction.

If this luminous module 1 is used for a luminous unit 7, for example an advertising panel, comprising a housing frame, then the latter frames the connection carrier 3 with the radiation-emitting semiconductor components 2 and at the same time conceals the thermally conductive elements 5*b* and also the projecting edge of the basic body 4.

The luminous module 1 can be fixed to the housing frame 8 by means of the projecting edge of the basic body 4. Therefore, the cooling body 6 is simultaneously in thermal contact with the housing frame. Advantageously, the housing frame contains a material having a thermal resistance that is less than or equal to the thermal resistance of the basic body 4. This enables good cooling of the luminous module 1 in the upper and middle regions.

It should be noted that, in the case of thermally noncritical systems, the temperature equalization within the luminous module can be achieved most simply by increasing the thermal resistance in the lower region at the expense of a higher temperature and an associated higher junction temperature. In the case of thermally critical systems with limit-value temperatures, a reduction of the thermal resistance in the middle and upper regions is advantageous.

Figure 15:
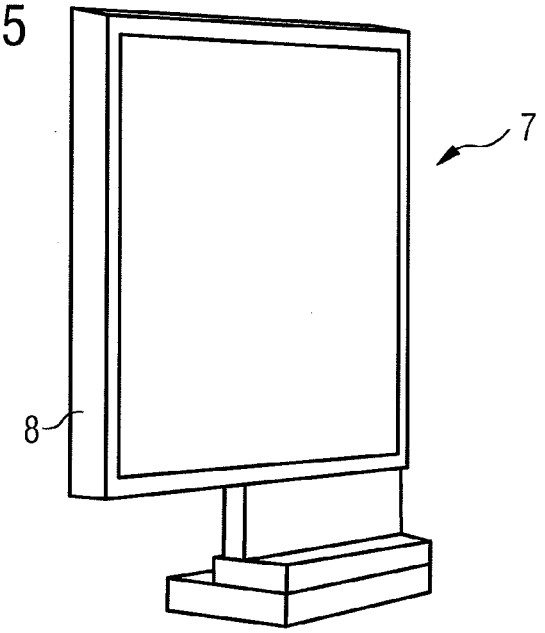
FIG. 15 shows a perspective illustration of an advertising panel.

FIG. 15 shows a perspective illustration of an advertising panel 7. The advertising panel 7 is installed in an upright fashion. The external dimensions of the advertising panel are 1.10 m×2 m.

The advertising panel 7 has a photographic image (not illustrated) enclosed by a housing frame 8. The photographic image is illuminated by a luminous module as described above, which cannot be seen in the image.

The invention is not restricted by the description on the basis of the exemplary embodiments. Rather, the invention encompasses any novel feature and also any combination of features, which in particular includes any combination of features in the patent claims, even if this feature or this combination itself is not explicitly specified in the patent claims or exemplary embodiments.

We claim:

1. A luminous module comprising:

a plurality of radiation-emitting semiconductor components;

a connection carrier, on which the radiation-emitting semiconductor components are arranged; and a cooling body, which, on its front-side surface, is connected to the connection carrier and comprises a basic body and a means to locally alter the thermal resistance of the cooling body, wherein:

the average thermal resistance of the cooling body decreases along at least a portion of a main extension direction of the luminous module, the main extension direction being opposite to the direction of a force of gravity when the luminous module is mounted in an upright position, the means to locally alter the thermal resistance of the cooling body comprises at least one thermally insulating element having a greater thermal resistance than the basic body of the cooling body; and the at least one thermally insulating element comprises a plurality of thermally insulating elements on a rear-side surface or on at least one side area of the cooling body, a number of thermally insulating elements decreasing per unit area along at least a portion of the main extension direction.

2. The luminous module according to claim 1, wherein the radiation-emitting semiconductor components are distributed uniformly on the connection carrier.

3. The luminous module according to claim 1, wherein the basic body of the cooling body contains a metal or consists of a metal.

4. The luminous module according to claim 1, wherein the means to locally alter the thermal resistance of the cooling body is distributed non-uniformly in the cooling body.

5. The luminous module according to claim 1, wherein the thermally insulating element is formed from a plastics material.

6. The luminous module according to claim 1, wherein the thermally insulating element is a cutout in the basic body of the cooling body, said cutout being filled with a material having a higher thermal resistance than the basic body.

7. The luminous module according to claim 6, wherein the cooling body comprises a plurality of cutouts arranged in regions that are not covered by the radiation-emitting semiconductor components.

8. The luminous module according to claim 1, wherein the means to locally alter the thermal resistance of the cooling body further comprises at least one thermally conductive element having a thermal resistance that is less than or equal to the thermal resistance of the basic body.

9. The luminous module according to claim 8, wherein a second number of thermally conductive elements per unit area increases along at least a portion of the main extension direction.

10. The luminous module according to claim 8, further comprising at least one thermally conductive element arranged on the front-side surface of the cooling body.

11. The luminous module according to claim 10, wherein the at least one thermally conductive element contains a metal or consists of a metal.

12. The luminous module according to claim 1, wherein the means to locally alter the thermal resistance of the cooling body is at least partly a fixing means.

13. A luminous module comprising:

a plurality of radiation-emitting semiconductor components;

a connection carrier on which the radiation-emitting semiconducting components are arranged; and a cooling body having a front-side surface connected to the connection carrier, the cooling body comprising a basic body and a means to locally alter the thermal resistance of the cooling body;

the luminous module having a main extension direction opposite to the direction of a force of gravity when the luminous module is mounted in an upright position, wherein:

the average thermal resistance of the cooling body decreases along at least a portion of the main extension direction of the luminous module, the means to locally alter the thermal resistance of the cooling body comprises at least one thermally insulating element having a greater thermal resistance than the basic body of the cooling body, and the means to locally alter the thermal resistance comprises at least one thermally conductive element having a thermal resistance less than or equal to the thermal resistance of the main body.

* * * * *